United States Patent [19]

Dolezal et al.

[11] Patent Number: 4,515,228

[45] Date of Patent: May 7, 1985

[54] AIR GROOVE SCRAPER

[75] Inventors: George E. Dolezal, Friendswood; Joseph L. Kelly, Jr., Houston, both of Tex.

[73] Assignee: Hughes Tool Company - USA, Houston, Tex.

[21] Appl. No.: 555,735

[22] Filed: Nov. 28, 1983

[51] Int. Cl.[3] ..... E21B 12/06

[52] U.S. Cl. ..... 175/313; 175/339

[58] Field of Search ..... 175/313, 331, 337, 371, 175/17, 339, 340, 372

[56] References Cited

U.S. PATENT DOCUMENTS

| | | | |
|---|---|---|---|
| 2,769,616 | 11/1956 | Morlan et al. | 175/313 |
| 2,960,313 | 11/1960 | Goodwin | 175/313 |
| 3,013,621 | 12/1961 | Kinnear | 175/313 |
| 3,921,735 | 11/1975 | Dysart | 175/337 |
| 4,096,917 | 6/1978 | Harris | 175/228 |
| 4,156,470 | 5/1979 | Bodine et al. | 175/313 |
| 4,183,417 | 1/1980 | Levefelt | 175/339 |
| 4,287,957 | 9/1981 | Evans | 175/17 |
| 4,375,242 | 3/1983 | Galle | 175/228 |

*Primary Examiner*—James A. Leppink
*Assistant Examiner*—Hoang C. Dang
*Attorney, Agent, or Firm*—Robert A. Felsman; H. Dennis Kelly

[57] ABSTRACT

An earth boring rock bit having a sealed bearing with air or gas as the circulating medium. An annular groove is formed in the vicinity of the seal and connected to the interior of the bit for cooling the seal and cleaning debris from the area of the seal. An air groove scraper is mounted on the shaft in the exit port of the annular groove to prevent the annular groove from becoming plugged by debris mixing with moisture in the hole.

4 Claims, 4 Drawing Figures

AIR GROOVE SCRAPER

BACKGROUND OF THE INVENTION

1. Field of the Invention

This invention relates in general to rock bits used for earth boring, and in particular to improvements in the sealing system for such bits.

2. Description of the Prior Art

U.S. Pat. No. 4,375,242, which issued to Edward M. Galle on Mar. 1, 1983, shows a rock bit which contains a journal or friction bearing and a pressure lubrication system to provide lubricant to the rotatable cutter and supporting shaft. A seal, preferably an O-ring, is provided between the cutter and shaft to retain lubricant within the bearing. An annular groove is formed between the cutter and the leg, adjacent to, but exterior of, the annular seal, for connection with the interior of the bit to provide air flow around the O-ring to cool the ring and to protect the ring from abrasive material. A lubricant pressure system has a movable element, one side of which communicates with the interior of the bit, such that the pressure of the air biases the movable element and lubricant toward the bearing and maintains a positive pressure within the bearing.

Environmental concerns necessitate the introduction of water into the air circulated through the bit. Furthermore, it is not uncommon for the bit to encounter water from other sources, such as ground or surface water, while drilling. This water mixes with the fine rock particles produced by the bit to form a mortar-like substance which can enter and plug the annular groove, especially when the flow of air to the bit is stopped and the bit is not removed from the hole. Once the annular groove is plugged, the air can no longer circulate through the annular groove and cool the seal.

SUMMARY OF THE INVENTION

The general object of the invention is to provide a sealed and lubricated rock bit with an air protected seal ring, in which the annular air groove does not become plugged with fine rock particles.

In general, this object is accomplished by the provision of a scraper in the annular groove. In the preferred embodiment, the annular groove is formed entirely in the cutter, and the scraper is a small pin mounted in the leg. As the cutter rotates, the annular groove rotates past the scraper, and the scraper removes any accumulations of rock particles in the groove.

Preferably, the air groove scraper is located in the exit port of the annular groove. The rock particles are blown out the exit port as the particles are removed from the groove by the scraper.

The above, as well as additional objects, features and advantages of the invention, will become apparent in the following detailed description.

DESCRIPTION OF THE PREFERRED EMBODIMENT

Figure 1:
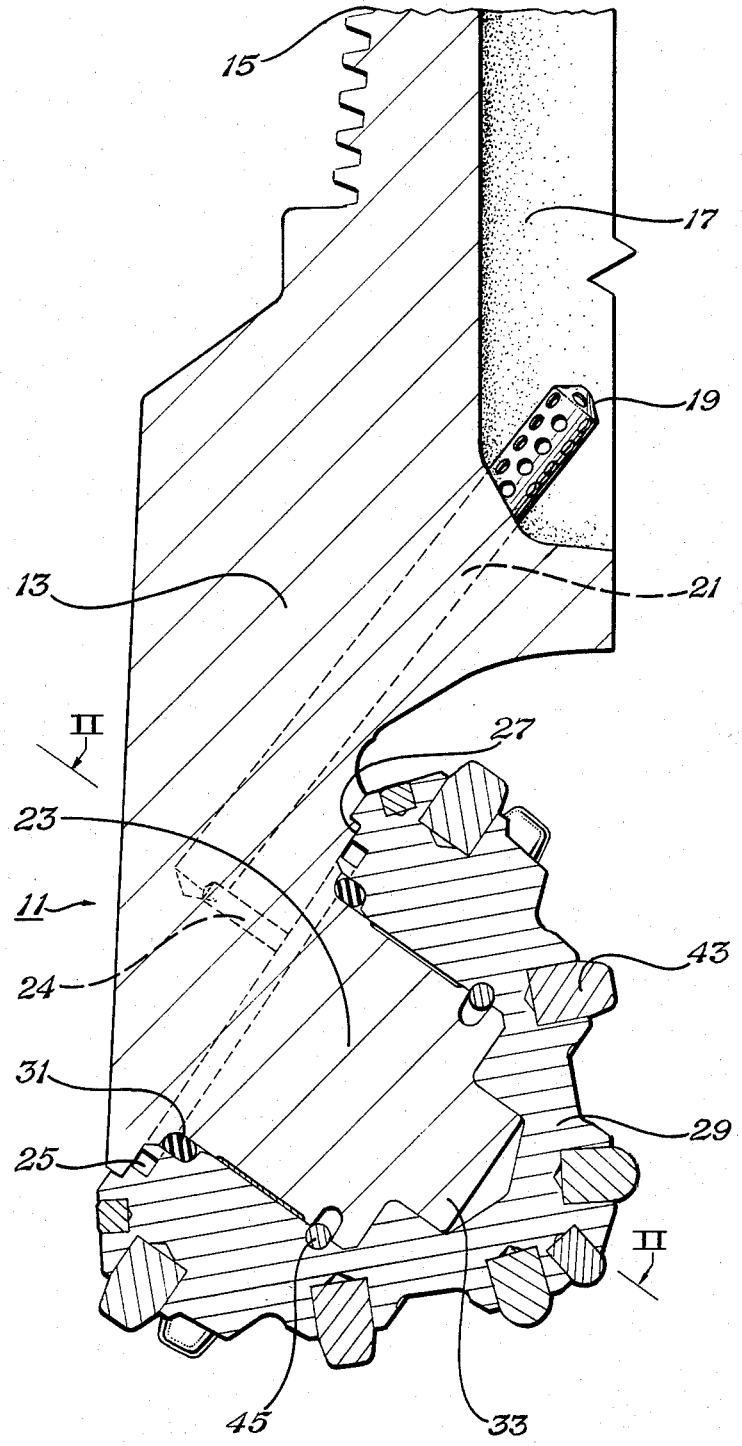
FIG. 1 is a sectional side view of an improved earth boring bit.

Referring initially to FIG. 1 of the drawing, the earth boring bit 11 has a body consisting generally of three legs 13, one of which is shown in FIG. 1 with the upper, threaded end broken away at 15. The threaded portion is used for attaching the earth boring bit 11 to a drill steel (not shown) which supports the bit, raises and lowers the bit in the hole, rotates the bit and provides air or gas to a hollow interior 17. The air or gas is filtered through a perforated tube 19 and introduced to a gas passage 21 which extends obliquely through the leg 13 and intersects a second gas passage 24, which leads to an annular groove 25 formed in the radial surface 27 of a cone or cutter 29. The annular groove 25 is adjacent to, but exterior of, an O-ring 31 used to seal lubricant between the bearing 33 and the cutter 29.

Figure 2:
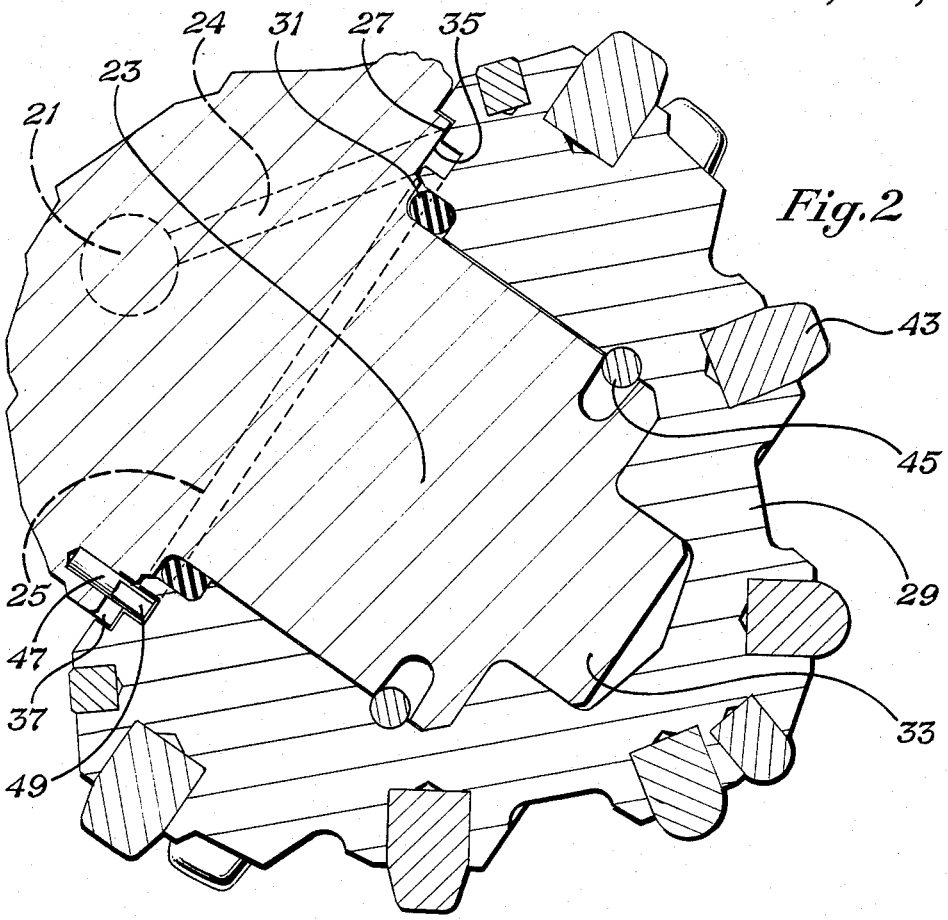
FIG. 2 is a cross sectional view as seen looking along the lines II—II of FIG. 1.
Figure 4:
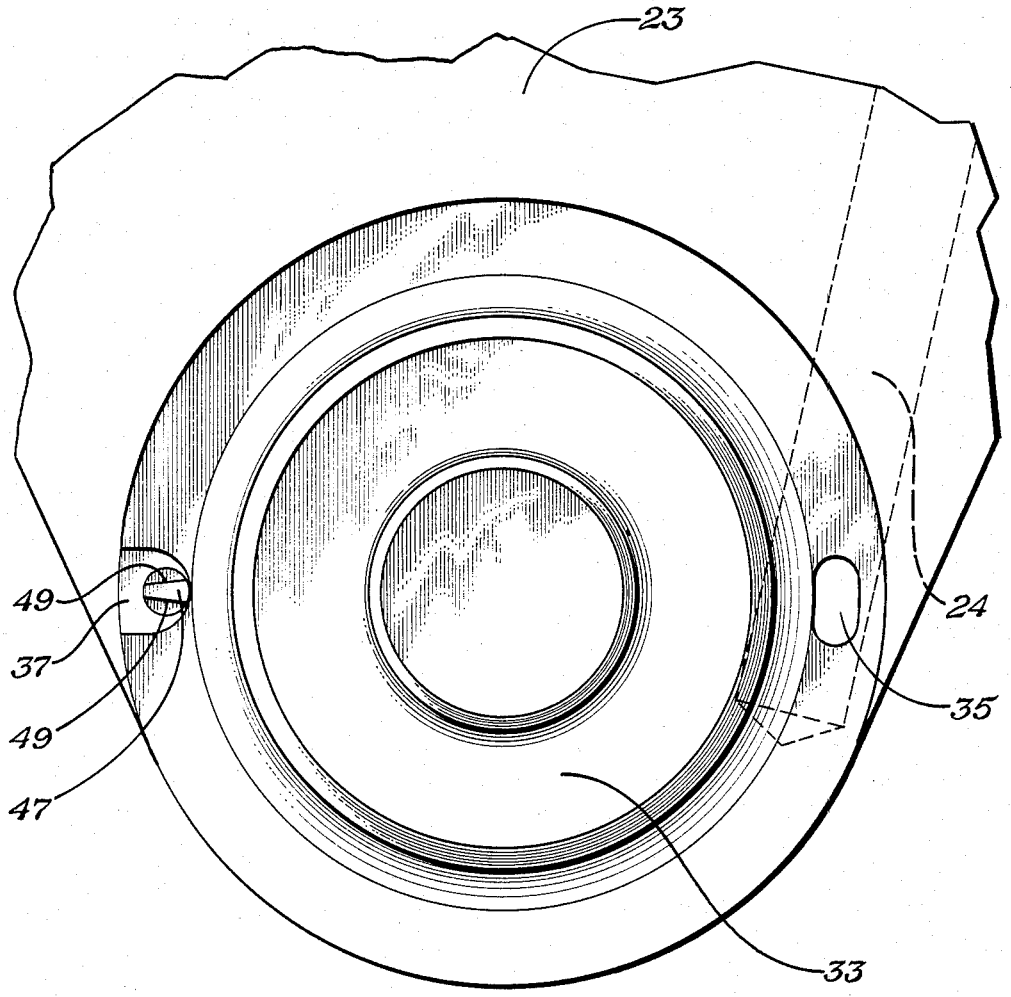
FIG. 4 is an end view of a rock bit bearing with the cutter removed.

As seen in FIGS. 2 and 4, the gas passage 24 has an opening 35 into the annular groove 25 on one side of the bearing 33. There is an exit port 37 formed on the opposite side of the bearing 33, so that air or gas flows along the entire length of the O-ring 31 for maximum cooling and protection from abrasive materials.

The preferred bearing shown in FIG. 1, is a journal bearing 33, and supports the cutter 29, which has a plurality of sintered tungsten carbide inserts 43 inserted in mating drilled holes within the cutter 29. The cutter 29 is retained rotatably on the bearing 33 by means of a retaining ring 45. The retaining ring 45 is compressed during assembly to allow the cutter 29 to be installed.

Figure 3:
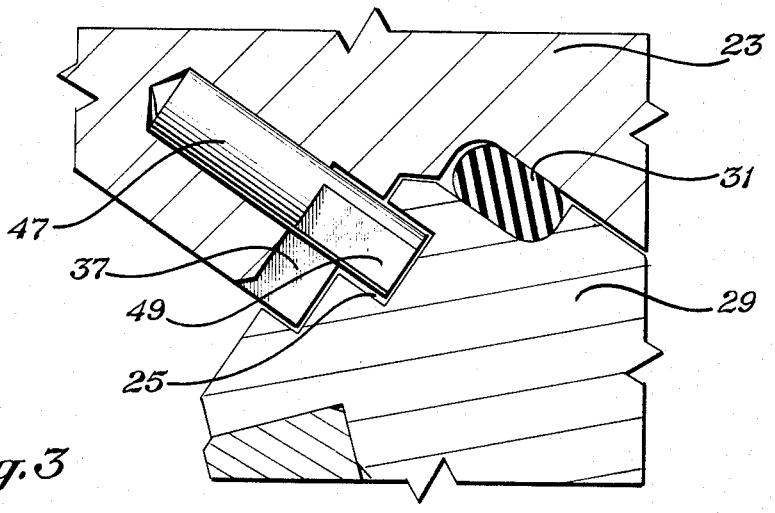
FIG. 3 is an enlarged sectional view of the air groove scraper.

As shown in FIGS. 2, 3, and 4, an air groove scraper 47 is mounted on the leg 13 in the exit port 37, so that the scraper 47 extends into the annular groove 25. The scraper 47 is generally cylindrical and is inserted in a mating drilled hole in the leg 13. The portion of the air groove scraper 47 which extends into the annular groove 25 has a pair of flat sides 49, which deflect the air and rock particles from the annular groove 25 to the exit port 37.

In operation, and during drilling of a hole, air or gas is pumped through the earth boring bit 11 to cool the bit 11 and to remove cuttings from the hole. Water, which is mixed with air to suppress dust, or which enters the hole from surface or subsurface sources, wets the rock cuttings produced by the bit 11 while drilling. The finer cuttings mix with the water to form a mortar-like substance which can flow into groove 25 when air flow is interrupted to add drill steel, to conduct drill maintenance, or by compressor overload, for example. This substance can plug the groove 25 and stop or retard the flow of air through the groove 25, especially if the air flow interruption is long enough to permit the substance to solidify. Such long air flow interruptions are common in blast hole drilling in particular. When drilling resumes, the cutter 29 rotates on the bearing 33 and each portion of the annular groove 25 passes by the air groove scraper 47. The scraper 47 removes the material from the groove 25 and directs it out of the exit port 37. By keeping the groove 25 free of solid material, the air groove scraper 47 allows the cooling air to flow freely through the annular groove 25 and to more effectively cool the O-ring 31. Also, any abrasive material which finds its way into the annular groove 25 by entering between the cutter 29 and the bit leg 13 will be immediately flushed out of the groove 25 by the flow of air or gas through the groove 25, thus protecting the O-ring 31.

While the invention has been shown in only one of its forms, it should be apparent to those skilled in the art that it is not thus limited, but it is susceptible to various changes and modifications without departing from the spirit thereof.

We claim:

1. An improved earth boring bit having a body with a hollow interior, a leg with a depending shaft to support a bearing, a rotatable cutter on the bearing, an annular seal between the cutter and the shaft, an annular groove formed in a radial surface at the end of the cutter and shaft adjacent to, and exterior of, the annular seal, with an air exit port, and a gas passage extending from an opening in the annular groove to the interior of the bit, wherein the improvement comprises:

a scraper in the annular groove to prevent the annular groove from becoming plugged.

2. An improved earth boring bit having a body with a hollow interior, a leg with a depending shaft to support a bearing, a rotatable cutter on the bearing, an annular seal between the cutter and the shaft, an annular groove formed in a radial surface at the end of the cutter and shaft, adjacent to, and exterior of, the annular seal, with an air exit port, and a gas passage extending from an opening in the annular groove to the interior of the bit, wherein the improvement comprises:

a scraper mounted on the shaft and in the annular groove to prevent the annular groove from becoming plugged.

3. An improved earth boring bit having a body with a hollow interior, a leg with a depending shaft to support a bearing, a rotatable cutter on the bearing, an annular seal between the cutter and the shaft, an annular groove formed in a radial surface at the end of the cutter and shaft, adjacent to, and exterior of, the annular seal, with an air exit port, and a gas passage extending from an opening in the annular groove to the interior of the bit, wherein the improvement comprises:

a scraper mounted on the shaft and in the air exit port of the annular groove to prevent the annular groove from becoming plugged.

4. An improved earth boring bit having a body with a hollow interior, a leg with a depending shaft to support a bearing, a rotatable cutter on the bearing, an annular seal between the cutter and the shaft, an annular groove formed in a radial surface at the end of the cutter and shaft, adjacent to, and exterior of, the annular seal, with an air exit port, and a gas passage extending from an opening in the annular groove to the interior of the bit, wherein the improvement comprises:

a scraper mounted on the shaft and in the air exit port of the annular groove to prevent the annular groove from becoming plugged;

wherein the scraper has sides which deflect gas out of the exit port.

* * * * *